United States Patent [19]

Pless

[11] 3,949,695

[45] Apr. 13, 1976

[54] MULTI-HULL SAILING VESSELS

[76] Inventor: John H. Pless, 58 Tite St., London, S.W.3, England

[22] Filed: Sept. 4, 1974

[21] Appl. No.: 503,113

[30] Foreign Application Priority Data

Sept. 5, 1973 United Kingdom ..... 41789/73

[52] U.S. Cl. ..... 114/66.5 H; 114/39

[51] Int. Cl.[2] ..... B63B 1/28

[58] Field of Search ..... 114/66.5 H, 123, 126, 39

[56] References Cited

UNITED STATES PATENTS

| | | | |
|---|---|---|---|
| 3,031,999 | 5/1962 | Bader | 114/66.5 H |
| 3,223,064 | 12/1965 | White | 114/39 |
| 3,561,388 | 2/1971 | Keiper | 114/66.5 H |
| 3,789,789 | 2/1974 | Cleary | 114/66.5 H |

*Primary Examiner*—Trygve M. Blix
*Assistant Examiner*—Stuart M. Goldstein
*Attorney, Agent, or Firm*—Kemon, Palmer & Estabrook

[57] ABSTRACT

A multi-hull sailing vessel includes at least a pair of opposing hydrofoils that have their longitudinal axes inclined inwardly toward one another beneath the vessel at a fixed angle to the horizontal, each foil being independently rotatable whereby the angle of attack of each hydrofoil can be adjusted to assist in maintaining the vessel in an upright position. The rotation of the hydrofoils can be automatic to produce greater lift for the leeward hydrofoil to resist the tendency of the vessel to heel to leeward.

4 Claims, 3 Drawing Figures

MULTI-HULL SAILING VESSELS

When a hydrofoil moves through the water it acts as a "water-wing" in a similar manner to the wing of an aircraft. The movement of the foil through the water creates a pressure difference between the top and bottom surfaces of the foil so that the vessel to which the foil is attached is lifted upwards. The longitudinal axis of the hydrofoil is generally inclined at a fixed angle to the horizontal beneath the water surface, and the transverse axis of the foil is further inclined relative to the direction in which the foil moves through the water. It is this latter angle of incidence (angle of attack) which primarily determines the amount of lift for a given velocity.

In a sailing vessel, opposing hydrofoils on each side of a single hull (or extending from the outermost hulls in a multi-hull vessel), are sometimes used to lift the hull or hulls out of the water when the vessel reaches a certain speed. However, since the foils generally have the same orientation, the windward foil produces the same lift as the leeward foil and, assuming both foils are beneath the water, there is still a tendency for the vessel to heel to leeward.

SUMMARY OF THE INVENTION

In accordance with the present invention the longitudinal axes of at least a pair of opposing hydrofoils fitted to a sailing vessel are inclined inwardly toward one another beneath the vessel at a fixed angle to the horizontal, but the orientation of the transverse axis of each foil is adjustable. In this manner the angle of attack for each hydrofoil can be adjusted independently to assist in maintaining the vessel in an upright position.

In a preferred embodiment of the invention each hydrofoil is rotatable through a predetermined angle about an axis parallel to, but offset from, its longitudinal axis. Because of their opposite inclinations, rotation of each foil in a first direction (say clockwise) will increase the angle of attack for one hydrofoil and decrease the angle of attack for the second hydrofoil whereas rotation in the opposite direction will have the reverse effect.

Preferably each hydrofoil is freely rotatable between a pair of stops defining the predetermined angle. Thus, when the vessel is sailing, the force tending to push the vessel sideways across the water (which is generally resisted by the centre board or keel of the vessel) will act on the bottom surface of the leeward hydrofoil to rotate the hydrofoil against one of its stops but on the top surface of the windward hydrofoil to rotate it in the same direction against a corresponding stop. The offset axis about which each hydrofoil is rotatable is positioned so that the hydrofoils are automatically rotated in a direction which produces a greater angle of attack (and thereby greater lift) for the leeward hydrofoil than for the windward hydrofoil with the result that the tendency of the vessel to heel to leeward is resisted and the vessel is kept substantially upright. The stops are preferably positioned so that the windward hydrofoil produces no lift or even negative lift.

In one alternative embodiment the orientation of each hydrofoil which defines its angle of attack is responsive to the position of a boom or booms projecting from the mast or masts of the respective hull or hulls of the sailing vessel. Each boom is then linked to its associated hydrofoil by means of a ram or pulley system.

If desired, a manual override control enables adjustment of both hydrofoils independently of the automatic control.

The invention can be used with particular advantage in a sailing vessel embodying the invention which I have described and separately claimed in my co-pending Application Ser. No. 309,791, filed Nov. 27, 1972. In this latter Application I describe a multi-hull fore-and-aft rigged sailing vessel which includes at least a pair of substantially parallel rigidly interconnected hulls, the outermost hulls each including a mast for supporting a sail and a boom for extending the foot of the sail. By suitably spacing the hulls relative to the height of the centre of pressure of each sail above the foot of the respective mast, the heeling moments originating from the forces on each mast can be made to balance one another out so that there is a reduced tendency to capsize in strong winds. In a trimaran, for example, the masts are mounted on the two outer hulls and the boat is controlled from the main central hull.

BRIEF DESCRIPTION OF THE DRAWING

In order that the invention may be more clearly understood, one example will now be described with reference to the accompanying drawings in which.

DESCRIPTION OF THE PREFERRED EMBODIMENTS

Figure 1:
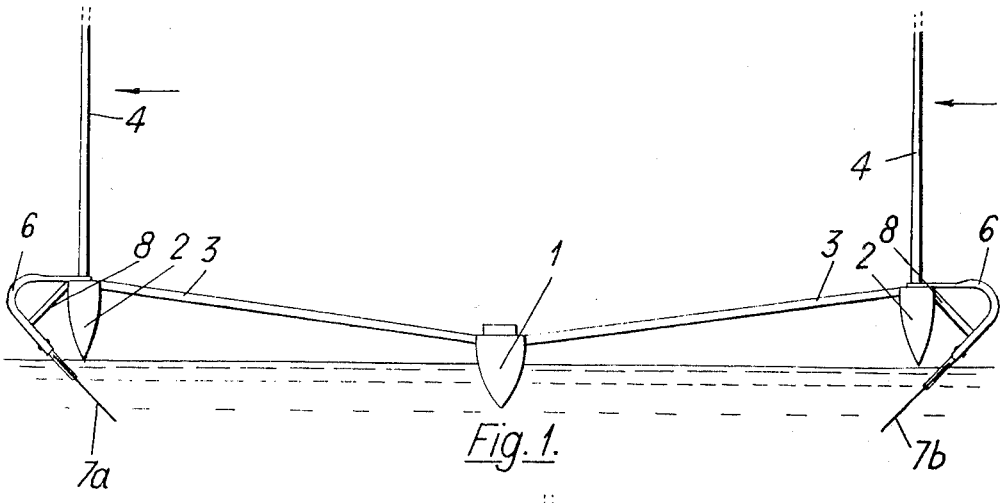
FIG. 1 is a front elevational view of a trimaran fitted with hydrofoils embodying the present invention.
Figure 2:
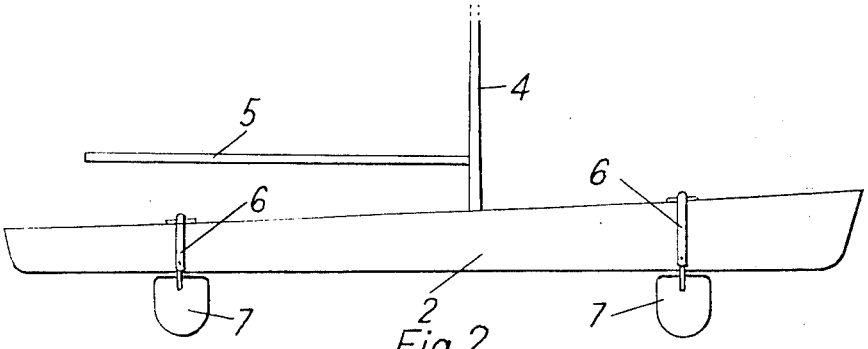
FIG. 2 is a side elevational view of the trimaran illustrated in FIG. 1.

FIG. 1 illustrates a multi-hull vessel having a central hull 1 rigidly interconnected with a pair of wing hulls 2 by means of upwardly inclined connecting struts 3. Each of the wing hulls 2 has a mast 4 stepped thereon and a boom 5 (FIG. 2) is pivotable about each mast.

Each of the wing hulls 2 includes a pair of generally U-shaped brackets 6, each bracket supporting a hydrofoil 7 at a fixed angle to the horizontal. Each bracket includes a cross piece 8 to provide additional support for the hydrofoil.

Figure 3:
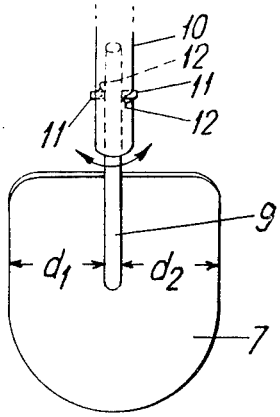
FIG. 3 illustrates the manner in which each hydrofoil is connected to its supporting bracket.

Referring to FIG. 3, each hydrofoil 7 includes a shaft 9 offset from the longitudinal axis of the hydrofoil such that the distance $d_1$ is less than the distance $d_2$. The shaft is inserted within a concentric tube 10 which forms one end of the bracket 6, and the shaft includes a pair of opposing pins 11 which engage in corresponding grooves 12 formed in the wall of the tube 10. The hydrofoil is therefore free to rotate between two end positions defined by the ends of the respective grooves 12. The permitted angular movement is about 4°.

With the wind blowing in the direction indicated by the arrows in FIG. 1, there will be a force on the lower surface of the hydrofoil **7*a* and a force on the upper surface of the hydrofoil 7*b* which will resist the movement of the vessel sideways across the water. If the offset axis about which each hydrofoil is rotatable is positioned aft of the longitudinal axis of each hydrofoil, such a force will produce an anticlockwise rotation of both hydrofoil 7*a* and hydrofoil 7*b*. However, because the hydrofoil 7*a* and the hydrofoil 7*b* are inclined on opposite sides of the vertical the effect will be that the leading edge of the hydrofoil 7*a* (the leeward hydrofoil) will be lifted to increase its angle of attack whereas the leading edge of the hydrofoil 7*b*** will drop to decrease the angle of attack. Thus the tendency of the vessel to heel to leeward will be counterbalanced by each pair of hydrofoils and the vessel will tend to remain in an upright position with the masts vertical.

I claim:

1. A sailing vessel including at least a pair of opposing hydrofoils having their longitudinal axes inclined inwardly toward one another beneath the vessel at a fixed angle to the horizontal, each hydrofoil being freely rotatable through a predetermined angle about an axis parallel to, but offset from, its longitudinal axis such that the angle of attack of each hydrofoil varies independently according to the forces acting on the hydrofoils when the vessel is sailing, the offset axis of each hydrofoil being positioned aft of the longitudinal axis such that the reactive forces on each hydrofoil which resist sideways movement of the vessel rotate the hydrofoils in opposite senses to increase the angle of attack of the leeward hydrofoil relative to that of the windward hydrofoil.

2. A multi-hull fore-and-aft rigged sailing vessel including at least a pair of substantially parallel, rigidly connected, spaced apart hulls, the outermost hulls each having stepped thereon a mast for supporting a sail and a boom for extending the foot of the sail, and the vessel further including at least a pair of opposing hydrofoils having their longitudinal axes inclined inwardly toward one another beneath the outermost hulls of the vessel at a fixed angle to the horizontal, each hydrofoil being freely rotatable through a predetermined angle about an axis parallel to, but offset from, its longitudinal axis such that the angle of attack of each hydrofoil varies independently according to the forces acting on the hydrofoils when the vessel is sailing, the offset axis for each hydrofoil being positioned aft of said longitudinal axis so that the reactive forces on each hydrofoil which resist sideways movement of the vessel rotate the hydrofoils in opposite senses to increase the angle of attack of the leeward hydrofoil relative to that of the windward hydrofoil.

3. The sailing vessel of claim 1 wherein said hydrofoils are rotatable through an angular movement of about 4 degrees.

4. A multi-hull fore-and-aft rigged sailing vessel including at least a pair of substantially parallel, rigidly connected, spaced apart hulls, the outermost hulls each having stepped thereon a mast for supporting a sail and a boom for extending the foot of the sail, and the vessel further including at least a pair of opposing hydrofoils having their longitudinal axes inclined inwardly toward one another beneath the outermost hulls of the vessel at a fixed angle to the horizontal, each hydrofoil being freely rotatable through a predetermined angle about an axis parallel to its longitudinal axis, each hydrofoil comprising a shaft carried within a concentric tube which is fixed to the vessel hull from which the hydrofoil depends, said shaft including a pair of opposing pins which engage in corresponding grooves formed in said concentric tube, said hydrofoil being free to rotate between two end positions defined by the ends of said groove, said shaft being offset from the longitudinal axis of the hydrofoil such that the distance from the shaft to the leading edge of the hydrofoil is greater than the distance from the shaft to the trailing edge of the hydrofoil.

* * * * *